US005396842A

United States Patent [19]

Quinci et al.

[11] Patent Number: 5,396,842

[45] Date of Patent: Mar. 14, 1995

[54] PRINTING PRESS INCLUDING IMPROVED GRIPPER ASSEMBLY

[75] Inventors: Emanuel Quinci, Dix Hills; Paul Emmanuel, Locust Valley, both of N.Y.

[73] Assignee: Halm Industries Co., Inc., Glen Head, N.Y.

[21] Appl. No.: 116,396

[22] Filed: Sep. 3, 1993

[51] Int. Cl.[6] ..... B41F 1/30

[52] U.S. Cl. ..... 101/409; 271/82; 271/277

[58] Field of Search ..... 101/185, 232, 409, 410, 101/183, 415.1; 271/82, 277

[56] References Cited

U.S. PATENT DOCUMENTS

| | | | |
|---|---|---|---|
| 2,599,776 | 6/1952 | Peyrebrune | 101/409 |
| 3,926,118 | 12/1975 | Preuss . | |
| 4,014,261 | 5/1977 | Becker . | |
| 4,101,122 | 7/1978 | Jeschke et al. | 271/277 |
| 4,375,190 | 3/1983 | Quinci et al. . | |
| 4,448,125 | 5/1984 | Kawaguchi et al. . | |
| 4,475,459 | 10/1984 | Wanke et al. . | |
| 4,718,342 | 1/1988 | Raab et al. | 101/409 |
| 4,815,379 | 3/1989 | Becker et al. . | |
| 4,947,748 | 8/1990 | Hiltwein et al. | 101/409 |
| 5,199,757 | 4/1993 | Simeth | 271/82 |

FOREIGN PATENT DOCUMENTS

| | | | |
|---|---|---|---|
| 0152553 | 8/1985 | European Pat. Off. | 101/409 |

*Primary Examiner*—Eugene H. Eickholt
*Attorney, Agent, or Firm*—Hoffmann & Baron

[57] ABSTRACT

A gripper assembly is provided for use within a printing press having an impression cylinder and one or more printing stations. The gripper assembly includes a main shaft, gripper clamp arms mounted to the shaft, and gripper blocks mounted to the shaft in alternating sequence with the gripper clamp arms. Each of the gripper blocks includes a projection overlying a portion of the adjoining gripper clamp arm. A spring is positioned between each projection and adjoining gripper clamp arm for urging the gripper blocks about the axis of the shaft. A gripper is mounted to each of the gripper blocks. Each gripper has a generally flat, Z-shaped body, one end of which is adapted for engaging a sheet of paper. The main shaft is coupled to a cam follower for causing rotation of the main shaft, thereby opening or closing the set of grippers.

20 Claims, 7 Drawing Sheets

PRINTING PRESS INCLUDING IMPROVED GRIPPER ASSEMBLY

BACKGROUND OF THE INVENTION

1. Field of the Invention

The field of the invention relates to printing presses including impression cylinders having one or more gripper assemblies for gripping the leading edges of successive sheets of paper.

2. Brief Description of the Related Art

Multi-color printing presses have been employed for printing sheets of paper sequentially at a plurality of printing stations with inks of different colors. Such presses may include an impression cylinder, an entrance cylinder for providing sheets of paper to the impression cylinder, an exit or delivery cylinder for removing printed sheets of paper from the impression cylinder, and a plurality of printing stations located between the entrance and exit cylinders. Each printing station typically includes a blanket cylinder engageable with the impression cylinder. Four such printing stations are frequently employed. The impression cylinder is often referred to as an impression drum in this type of application.

It is of paramount importance that sheets of paper fed to the impression cylinder are gripped so as to maintain proper registration as they are transported through the various printing stations. Small errors resulting from misregistration are readily observable in the printed sheets, and accordingly must be avoided.

The impression cylinder of a multi-color printing press usually supports a number of sheets of paper, each of which is gripped at its leading edge. A number of gripper assemblies are accordingly mounted within the impression cylinder, one for gripping the leading edge of each sheet supported by the cylinder. Each gripper assembly includes a plurality of grippers, also known as fingers, which are mounted to a shaft. The shaft is operated by a cam which opens and closes the grippers at the proper times to grip and release a sheet of paper. The fingers are urged towards the closed position by a spring. A spring may also be provided for absorbing the shock of the closing of the grippers. U.S. Pat. No. 4,375,190, which is incorporated by reference herein, discloses a four color printing press having eight gripper assemblies as described above.

Various other gripper assemblies have been designed for gripping the leading edges of sheets of paper within a printing press. U.S. Pat. Nos. 3,926,118, 4,014,261, 4,448,125, 4,475,459 and 4,815,379 disclose examples of such gripper assemblies.

As discussed above, it is important to grip a sheet of paper with sufficient force such that proper registration is maintained as it passes through the printing stations. The gripping force should not be excessive, however, to avoid leaving impressions on the sheets of paper.

The printing stations are often required to print sheets of paper near the leading edges thereof, including edge areas normally engaged by a gripper. The grippers should accordingly be individually removable to allow such printing.

SUMMARY OF THE INVENTION

It is an object of the invention to provide a printing press having a relatively compact gripper assembly for gripping the leading edges of sheets of paper.

It is another object of the invention to provide a gripper assembly which provides an even closing force across the entire assembly.

A further object of the invention is to provide a gripper assembly having easily removable grippers.

In accordance with these and other objects of the invention, which will be apparent from the specification which follows, a printing press is provided which includes an impression cylinder, a blanket cylinder, means for feeding sheets of paper to the impression cylinder, means for removing sheets of paper from the impression cylinder, a gripper assembly mounted to the impression cylinder, and means for opening and closing the gripper assembly. The gripper assembly includes a shaft, a plurality of gripper clamp arms mounted to the shaft, a plurality of gripper blocks mounted to the shaft in alternating sequence with the gripper clamp arms, and means for resiliently urging each of the gripper blocks about the shaft with respect to each of the respective gripper clamp arms. A gripper is mounted to each gripper block for engaging the leading edge of a sheet of paper on the impression cylinder. Means are provided for rotating the shaft between first and second positions in order to open or close the grippers with respect to the impression cylinder, thereby releasing or engaging a sheet of paper.

Each gripper block preferably includes an axial projection extending over a portion of the adjoining gripper clamp arm. A spring positioned between the projection and the gripper clamp arm resiliently urges the gripper block with respect to the gripper clamp arm towards the closed position. Each spring employed in the assembly preferably exerts a uniform force upon the gripper block, which results in each gripper exerting about the same force upon a sheet of paper.

DETAILED DESCRIPTION OF THE INVENTION

Figure 1:
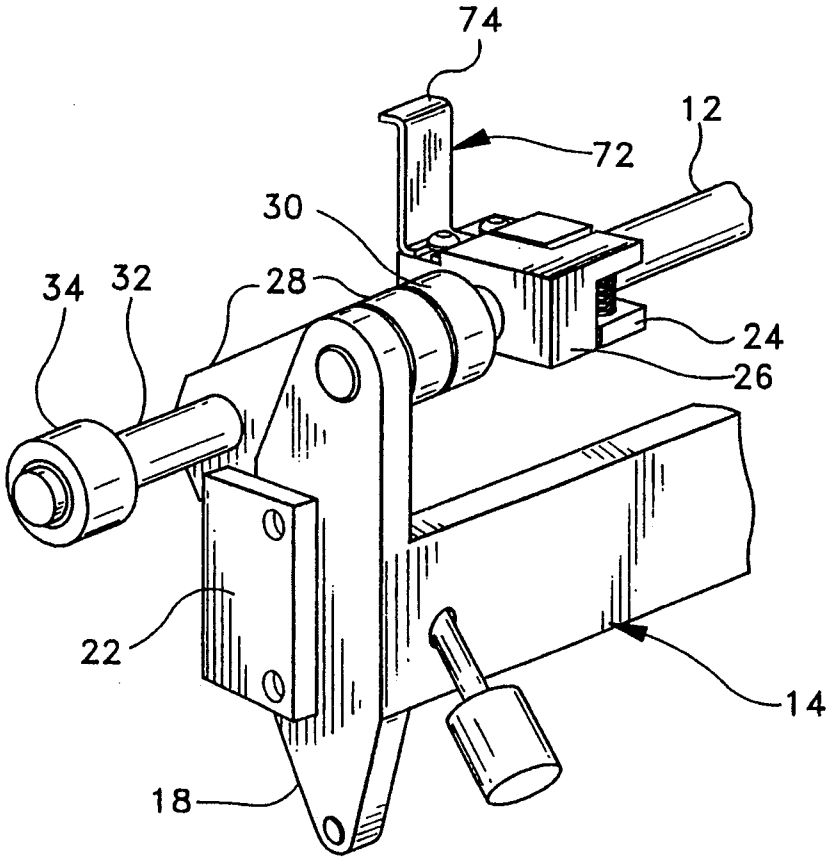
FIG. 1 is a top perspective view of a portion of a gripper assembly according to the invention showing a gripper in a closed position.
Figure 5:
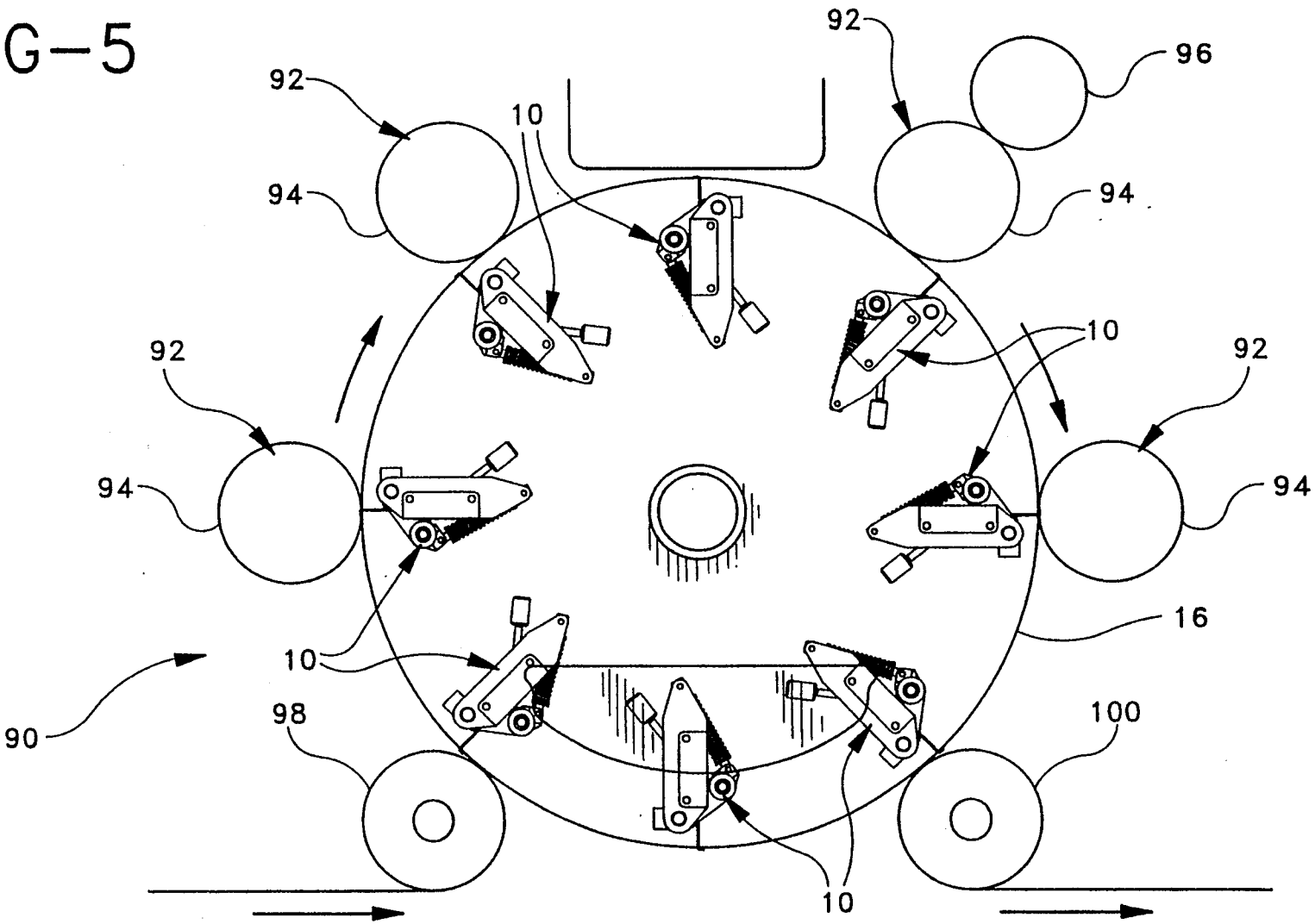
FIG. 5 is a schematical illustration of a four color printing press according to the invention.

A compact gripper assembly capable of firmly and evenly gripping a document positioned upon an impression cylinder is provided. Referring to FIG. 1, an end portion of such a gripper assembly 10 is shown. The assembly includes an elongate, substantially cylindrical main shaft 12. A frame 14 is provided for mounting the assembly to an impression cylinder 16, as shown in FIG. 5. The frame 14 includes a pair of opposing plates 18 connected by an elongate beam 20. The ends of the main shaft 12 are rotatably mounted to the respective plates 18. (The end of the assembly opposite to that shown in FIG. 1 is substantially a mirror image thereof). Each plate 18 includes a mounting plate 22 projecting outwardly therefrom for coupling the frame to the impression cylinder.

Figure 2:
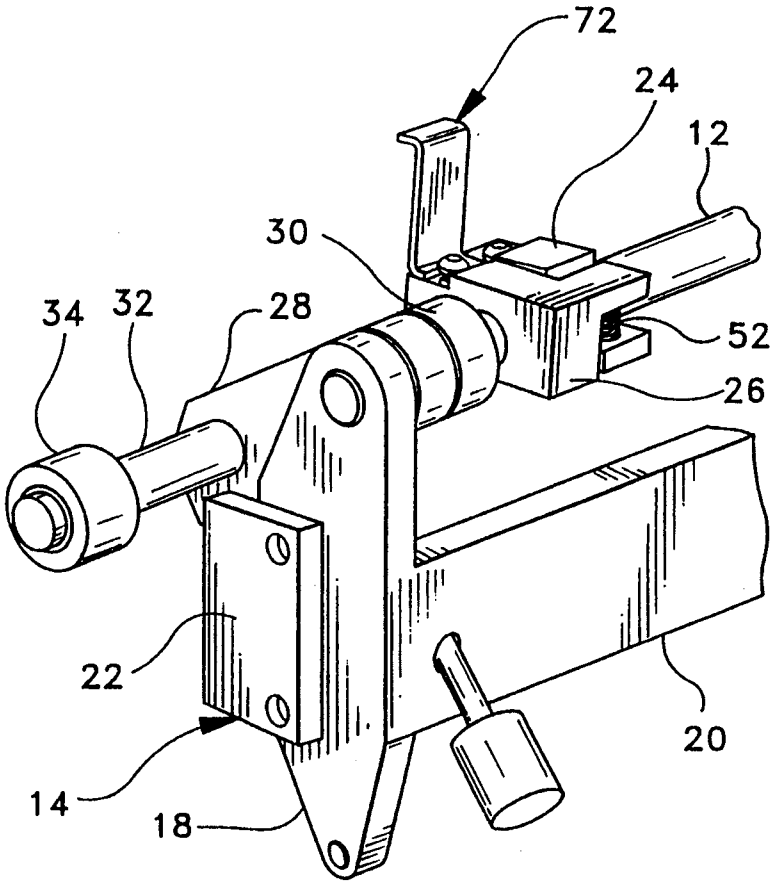
FIG. 2 is a similar view showing the gripper assembly in a second position.

The shaft 12 supports a plurality of gripper clamp arms 24 and gripper blocks 26, which will be described in greater detail below. The gripper clamp arms are fixedly mounted to the main shaft, while the gripper blocks are capable of limited rotation about the shaft. FIG. 2 shows the gripper block rotated clockwise several degrees from the position shown in FIG. 1. The gripper clamp arms are mounted to the shaft in alternating sequence with the gripper blocks.

An actuating arm 28 is fixedly mounted to each end of the main shaft, and separated from the gripper blocks nearest the ends of the shaft by respective cylindrical spacers 30. A relatively short shaft 32 extends outwardly from the arm on one side of the assembly only, and substantially parallel to the main shaft 12. A cylindrical cam follower 34 is rotatably mounted to this relatively short shaft 32.

Figure 3:
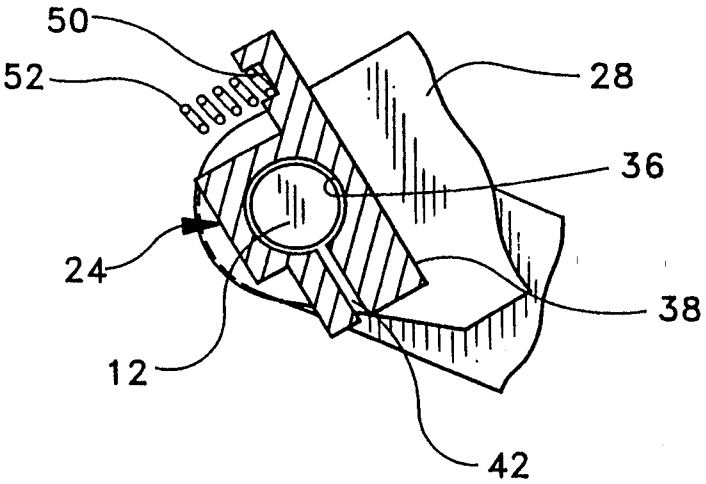
FIG. 3 is a sectional view showing a gripper clamp arm mounted to a shaft.

Referring to FIG. 3, a gripper clamp arm 24 is shown as mounted to the main shaft 12. This element includes an integral body having a cylindrical passage 36 extending therethrough for receiving the main shaft. A first end portion 38 of the gripper clamp arm is bifurcated. The bifurcated end portion adjoins the cylindrical passage such that the diameter of the passage can be adjusted when the two sections comprising the bifurcated end portion are moved towards or away from each other. A cylindrical passage 40 (FIG. 8) extends through the bifurcated end portion and substantially perpendicular to the space 42 which separates the sections thereof. A portion of the passage extending through one of the sections is threaded. A screw 44 (FIG. 8) inserted through the passage can accordingly be used to close or open the space 42, thereby fixing the gripper clamp arm to the main shaft 12 or releasing it. The space extends substantially perpendicularly with respect to the longitudinal axis of the shaft.

A second end portion 46 of the gripper clamp arm 24 extends from the central body portion 48 thereof in a direction opposite from the first body portion 38. A spring seat 50 is provided in this portion for receiving one end of a coil spring 52. Each spring employed in the assembly may have a free length of about three quarters of an inch. The springs may be about one half inch in the compressed mode.

Figure 4:
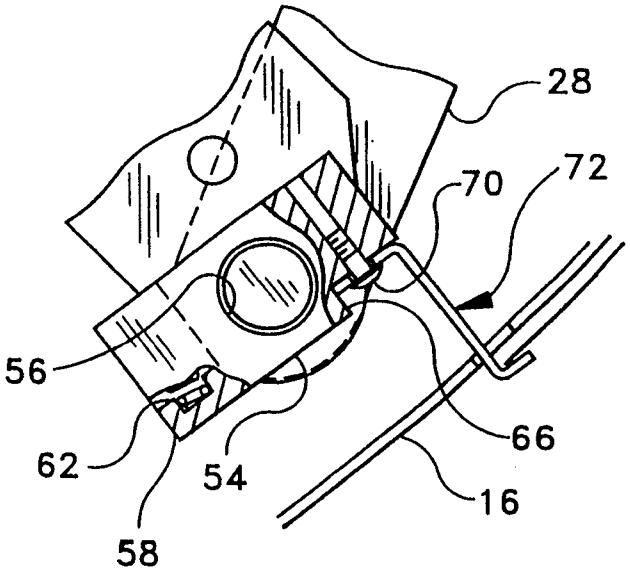
FIG. 4 is a partially sectional view showing a gripper block and a gripper extending through a slot in an impression cylinder.
Figure 8:
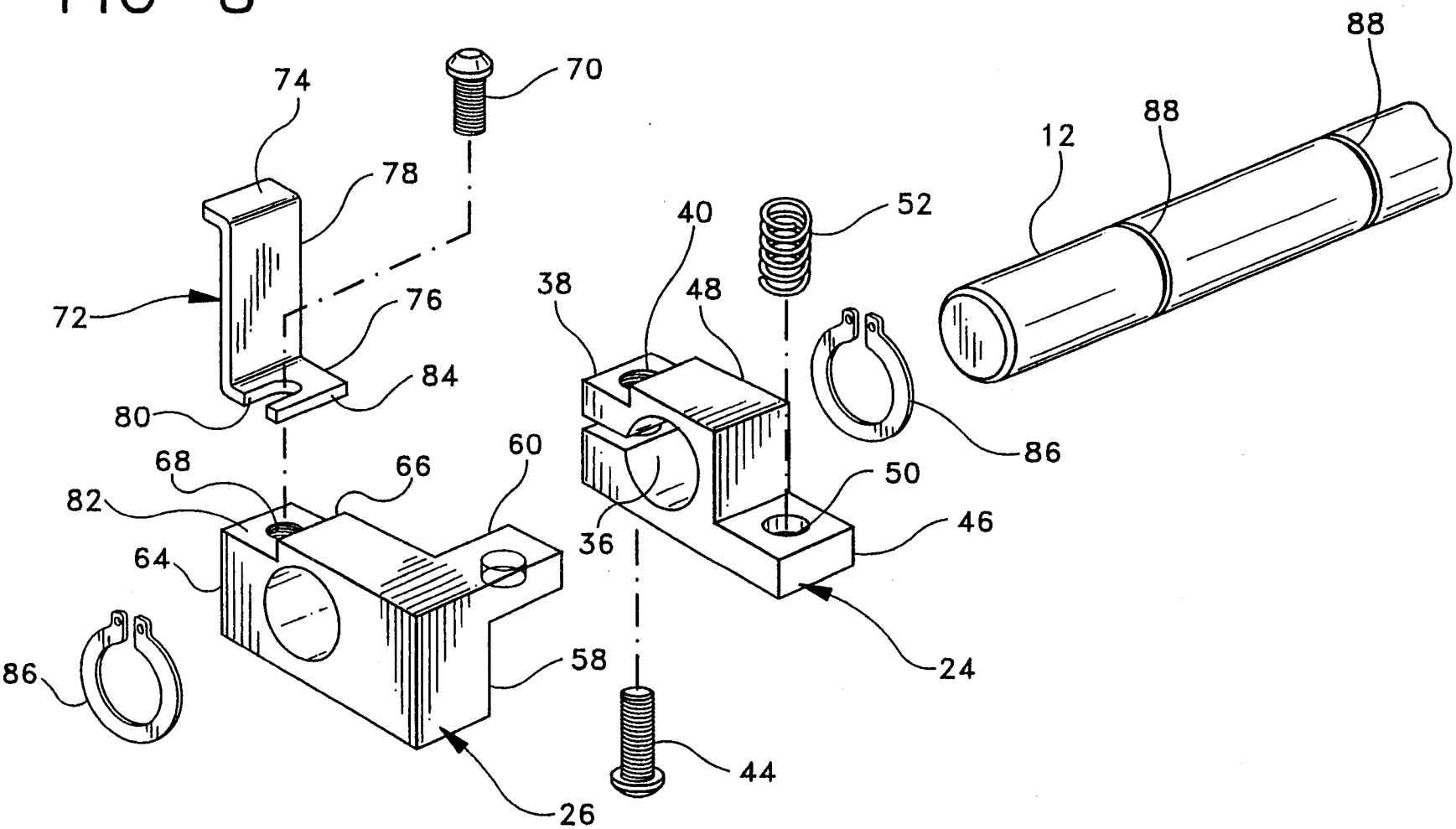
FIG. 8 is an exploded, perspective view of a portion of the gripper assembly.

Referring to FIGS. 4 and 8, the gripper block 26 includes a central body portion 54 having a cylindrical passage 56 extending therethrough. The cylindrical passage is slightly larger in diameter than the main shaft 12 which extends therethrough. The gripper block is accordingly rotatable about the main shaft.

A first end portion 58 of the gripper block includes a projection 60 including spring seat 62 for receiving the opposite end of the coil spring 52. The projection 60 extends substantially parallel to the passage 56, and a portion thereof extends over the second end portion 46 of the gripper clamp arm. The spring seats 50, 62 of each set of a gripper blocks and gripper clamp arms are accordingly in opposing relation to each other when mounted to the main shaft 12. The spring 52 urges the gripper block about the axis of the main shaft with respect to the gripper clamp arm.

A second end portion 64 of the gripper block adjoins the central body portion thereof. A shoulder 66 is defined by these two portions. The second end portion 64 includes a threaded passage 68 extending therethrough. A screw 70 is positioned within the passage 66, and retains a gripper 72 on this portion of the block.

Referring now to FIG. 8, each gripper 72 has a generally flat, Z-shaped body having first and second end members 74, 76 and a connecting member 78. The first end member 74 preferably has a rough (e.g., metal-sprayed) surface to facilitate gripping paper sheets. The second end member 76 includes a slot 80 through which the screw 70 extends. In accordance with a preferred embodiment of the invention, the gripper has a width of about one half inch and a length of about seven eighths of an inch. The body of the gripper may have a thickness of about 0.046 inches, and is made from spring-tempered steel. This provides sufficient rigidity as the gripper 72 should not flex upon engagement of the paper sheet. The end members preferably extend at right angles with respect to the connecting member. The first end member 74 has a length of about three sixteenths of an inch while the second end member 76 has a length of about 0.43 inches. The length and width of the second end member are substantially the same as those of the flat surface 82 of the second end portion of the gripper block 26. An edge 84 of the second end member accordingly adjoins the shoulder 66, as best shown in FIG. 4. It will be appreciated that the dimensions of the gripper may be different for different printing presses or where the sizes of the gripper blocks may be different. The materials from which the gripper block and gripper are made may also be other than steel for the grippers and aluminum for the gripper blocks. The gripper blocks preferably have hard anodized finishes when made from aluminum.

Each set of gripper blocks and gripper clamp arms are preferably maintained in position on the main shaft 12 by a pair of snap rings 86. The snap rings are maintained in position on the shaft by appropriately spaced grooves 88. Eight sets of gripper blocks and clamp arms are preferably employed, though this number may be varied as described below.

Referring to FIG. 5, a printing press 90 including four printing stations 92 and an impression cylinder 16 including eight gripper assemblies 10 is shown. Each printing station includes a blanket cylinder 94 adjoining the impression cylinder. A plate cylinder 96 may adjoin each blanket cylinder. An entrance drum 98 is provided for feeding sheets of paper to the impression cylinder 16. An exit drum 100 is provided for removing the sheets once they have passed through all four printing stations. A cam 102 is provided for opening and closing the grippers of each gripper assembly as the impression cylinder is rotated about its axis.

Figure 6:
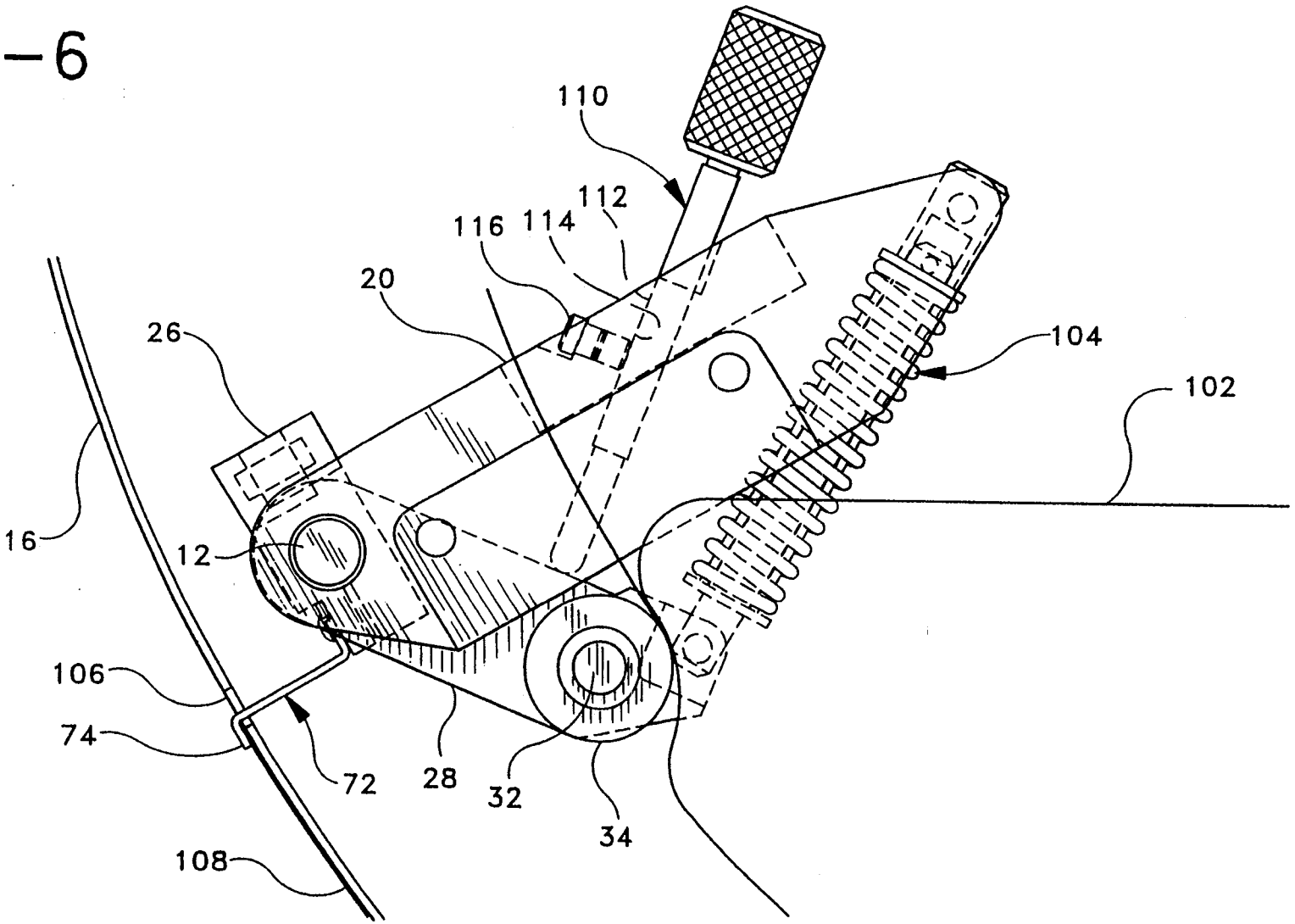
FIG. 6 is a side elevation view of the gripper assembly in a closed position.
Figure 7:
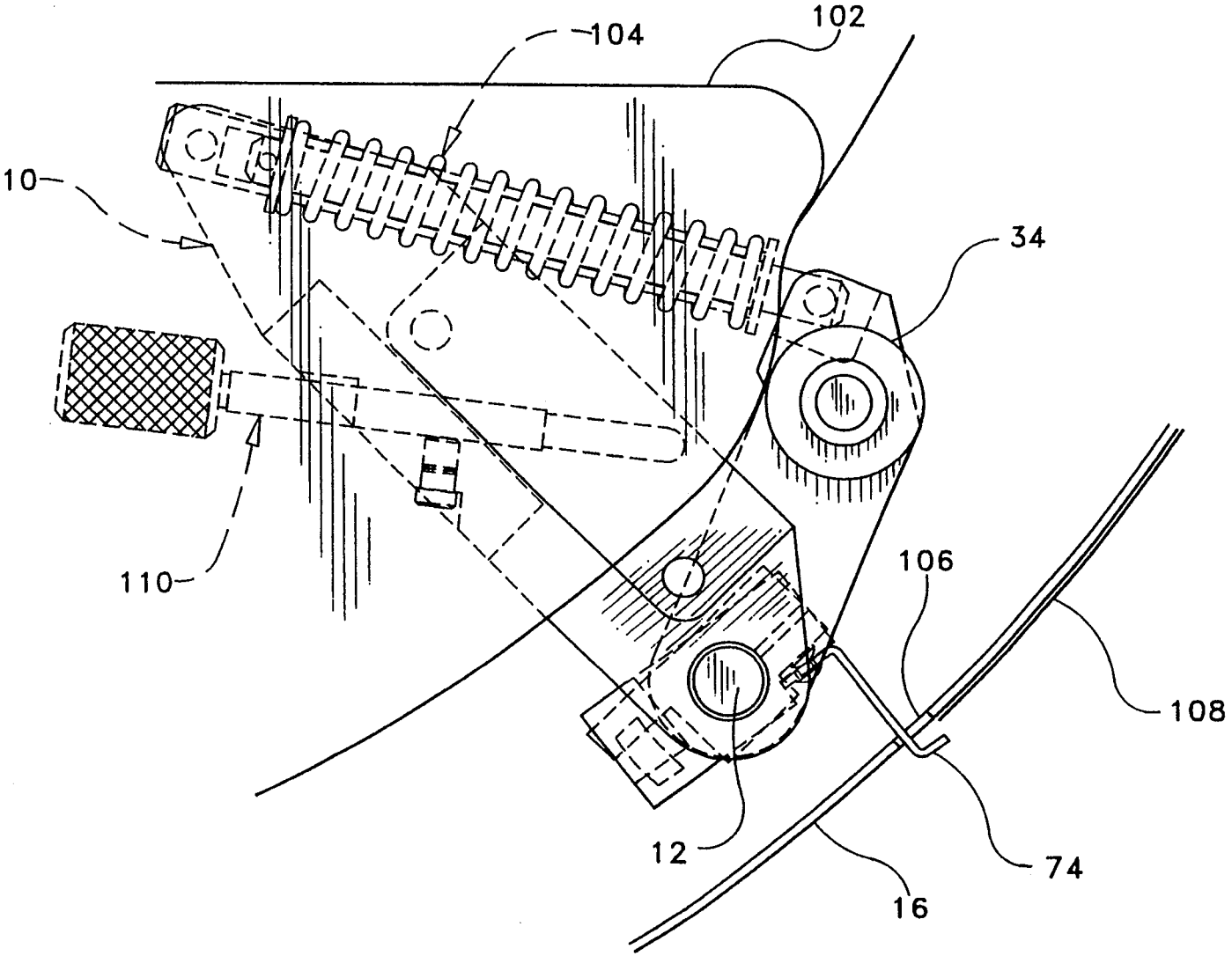
FIG. 7 is a side elevation view thereof wherein a cam is urging the gripper assembly into an open position.

FIGS. 6 and 7 show a gripper assembly 10 in the closed and open positions, respectively, as urged by the cam 102 which engages the cam follower 34. Referring to FIG. 6, the cam 102 is exerting substantially no influence upon the cam follower 34. A spring assembly 104 is pivotably mounted between the plate 18 and the arm 28 on each side of the gripper assembly 10, thereby urging the main shaft 12 to rotate in a first direction. The force exerted by each spring assembly 104 is about four times the force exertable by each coil spring 52.

The spring force of the spring assembly 104 may be adjusted to compensate for the use of a greater or fewer number of grippers from the eight which are normally employed. Such rotation causes the gripper clamp arms, gripper blocks and grippers to rotate such that the grippers are in the closed positions as shown in FIG. 6. A portion 74 of each gripper extends through a slot 106 in the impression cylinder. The leading edge of a sheet 108 of paper is engaged by the grippers 72 of the gripper assembly.

An adjusting mechanism 110 is provided for limiting the rotation of the main shaft 12 about its axis. The mechanism includes an elongate rod 112 which extends through a passage 114 in the elongate beam 20. A set screw 116 engages the rod 112 to maintain it in a selected axial position. The elongate rod 112 and passage 114 may both be threaded to allow precise positioning of the rod. The end of the rod 112 bears against the arm 28, which is urged against it by the spring assembly 104. The adjustment mechanism may be eliminated as the springs 52 are intended to determine the amount of pressure exerted on the sheet of paper. The end of the rod 112 never contacts the actuating arm 28 in normal operation.

Referring to FIG. 7, the gripper assembly 10 is shown in a position rotated from that shown in FIG. 6. This position is reached just as the gripper assembly moves past the exit drum 100 and releases a sheet of paper to be carried away by the drum. The engagement of the cam follower 34 by the cam 102 causes the displacement of the actuating arm 28 against the force of the spring assembly 104, thereby rotating the main shaft 12 and the grippers 72 mounted thereto. A printed sheet may accordingly be released at this point. The grippers are maintained in the open position by the cam until the gripper assembly passes the entrance drum. The cam follower 34 is then released, which allows the grippers to engage the leading edge of a new sheet.

Figure 10:
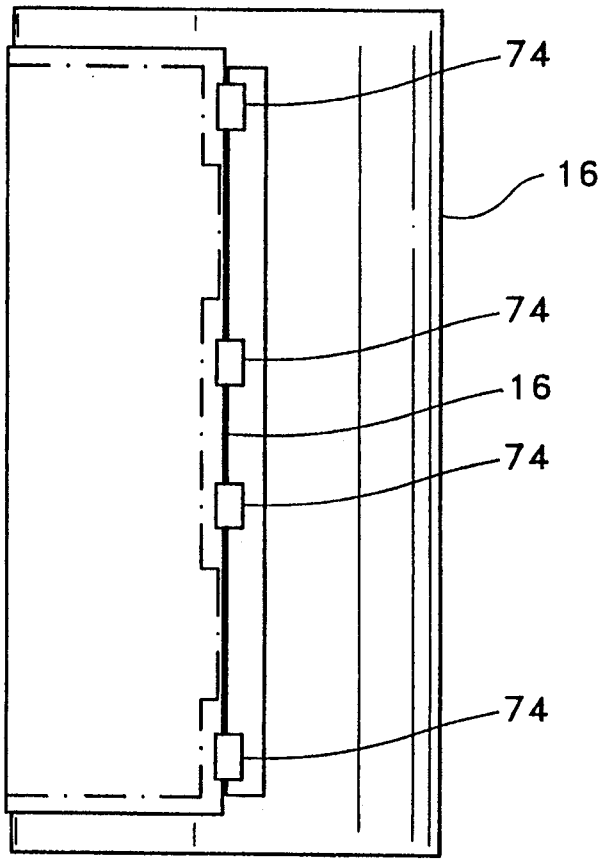
FIG. 10 is a similar view showing less than a full set of grippers extending outside the impression cylinder.
Figure 9:
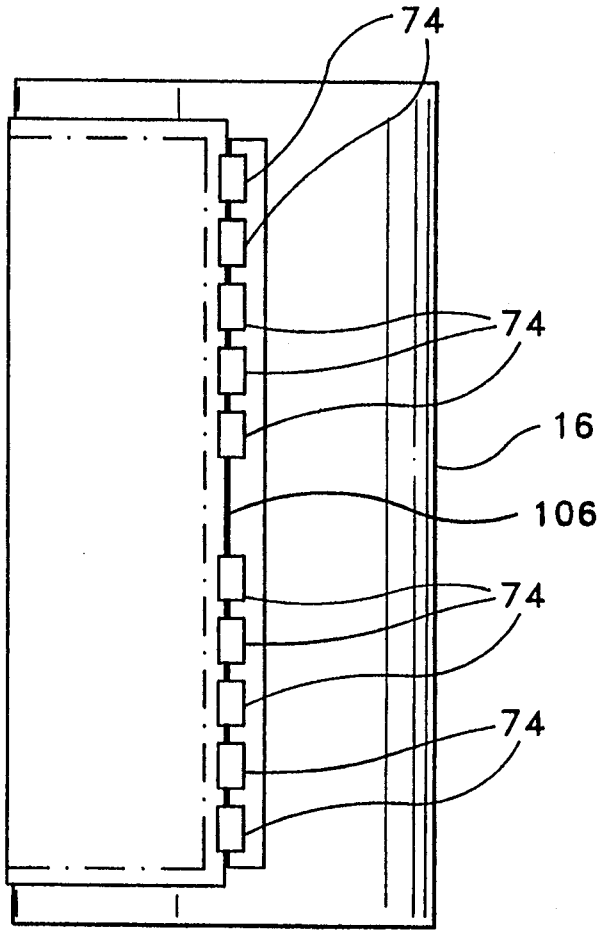
FIG. 9 is a top plan view of an impression cylinder having a full set of grippers mounted to a gripper assembly.

The gripper blocks and grippers are constructed such that removal of individual grippers is easily accomplished while the gripper assembly remains mounted to the impression cylinder. If no printing is required at the leading edges of the sheets, a full array of grippers are employed, as shown in FIG. 9. If such printing is required, some grippers are removed so that they do not interfere with the printing process. FIG. 10 shows an impression cylinder wherein a number of grippers have been removed.

The operation of the printing press 90 and printing assembly 10 shall now be described. Sheets 108 of paper are fed to the impression cylinder 16 from the entrance drum 98 or other equivalent sheet feeding assembly. The grippers 72 of an adjoining gripper assembly are in the open position as the sheet is delivered such that the leading edge is positioned beneath the first end members 74 thereof. The cam 102 shortly thereafter releases the cam follower 34, which allows the spring assembly 104 to move the actuating arm 28 towards the end of the rod 112 of the adjusting mechanism 110. This causes the main shaft 12 to rotate about its axis, and the grippers to engage the sheet. The springs 52 prevent excessive force from being exerted on the sheet by the grippers. The gripper blocks 26, and associated grippers 72, may rotate slightly upon engagement of the sheet from the position shown in FIG. 1 to that shown in FIG. 2. This rotation causes some additional compression of the springs 52. As each spring is capable of exerting substantially the same force, the grippers exert a substantially uniform force across the leading edge of the sheet, which force firmly retains the sheet without leaving noticeable impressions therein. Each gripper 72 operates independently of the other grippers of the assembly. When a full array of grippers is employed, the coil springs 52 urging the grippers towards the closed position each may cause about one pound of force to be exerted on the sheet. If the number of grippers must be greatly reduced, springs exerting a somewhat greater force may be employed.

The gripper assembly 10 maintains the sheet in place as it is transported by the impression cylinder through each printing station. An offset printing process is preferably employed at each station, though other techniques could alternatively be used.

As the gripper assembly 10 moves into adjoining relation to the exit drum 100 or other sheet removal means, the cam 102 reengages the cam follower 34, thereby causing the actuating arm to rotate about the axis of the main shaft 12 and against the force of the spring assembly 104. The resulting rotation of the main shaft 12 and associated gripper blocks 26 causes the grippers to rotate to the position shown in FIG. 7, thereby allowing the sheet to be removed from the impression cylinder. The gripper blocks 26 may return to the position shown in FIG. 1 as the springs 52 cause their rotation about the main shaft 12 with respect to the gripper clamp arms 24. Such rotation is limited by the engagement of the gripper block projections 60 with the central body portions 48 of the gripper clamp arms 24.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A printing press comprising:

an impression cylinder;

a printing station adjoining said impression cylinder;

means for feeding sheets of paper to said impression cylinder;

means for removing sheets of paper from said impression cylinder;

a gripper assembly mounted to said impression cylinder, said gripper assembly including a shaft, a plurality of gripper clamp arms mounted to said shaft, a plurality of gripper blocks mounted to said shaft in adjoining relation, respectively, with said gripper clamp arms, each of said gripper blocks including a step, means for resiliently urging each of said gripper blocks about said shaft with respect to each of said respective gripper clamp arms, and a gripper mounted to each of said gripper blocks, a portion of each of said gripper blocks, a portion of each gripper being adapted for engaging a sheet of paper upon said impression cylinder, and each gripper including a generally flat, Z-shaped body including first and second end members and a connecting member connecting said first and second end members, said second end members of said respective grippers each being secured to one of said respective gripper blocks and including an edge which adjoins said respective steps of said respective gripper blocks, said first end members extending outside said impression cylinder for engaging a sheet of paper, and means for moving said shaft between first and second positions, said grippers being in a closed position for engaging a sheet of paper when said shaft is in the first position and in an open position for accepting or releasing a sheet of paper when said shaft is in the second position.

2. A printing press as described in claim 1, wherein each of said gripper blocks includes a projection extending in the direction of the longitudinal axis of said shaft, each of said projections extending respectively over a portion of one of said respective gripper clamp arms, said means for resiliently urging said gripper blocks including a plurality of springs positioned, respectively, between each of said projections and said portions of said respective gripper clamp arms.

3. A printing press as described in claim 2, wherein each of said projections includes a depression for receiving an end of each of said respective springs.

4. A printing press as described in claim 3, wherein each of said portions of said gripper clamp arms includes a depression in opposing relation to one of said depressions of said projections, an end of each of said respective springs being positioned within said respective depressions within said portions.

5. A printing press as described in claim 1, wherein each of said gripper clamp arms is fixedly secured to said shaft, said gripper blocks being rotatable with respect to said shaft, said gripper clamp arms including means for limiting the rotation of said gripper blocks with respect to said shaft.

6. A printing press as described in claim 1, wherein said first and second end members of each gripper are substantially parallel to each other.

7. A printing press as described in claim 1, wherein each of said second end members includes a slot extending therethrough.

8. A printing press comprising:

an impression cylinder;

a printing station adjoining said impression cylinder;

means for feeding sheets of paper to said impression cylinder;

means for removing sheets of paper from said impression cylinder;

a gripper assembly mounted to said impression cylinder, said gripper assembly including a shaft, a plurality of gripper clamp arms mounted to said shaft, a plurality of gripper blocks mounted to said shaft in adjoining relation, respectively, with said gripper clamp arms, means for resiliently urging each of said gripper blocks about said shaft with respect to each of said respective gripper clamp arms, and a gripper mounted to each of said gripper blocks, a portion of each gripper being adapted for engaging a sheet of paper upon said impression cylinder, each of said gripper clamp arms including a central body portion having a passage extending therethrough, a bifurcated first end portion adjoining said central body portion and defining a space adjoining said passage, a second opposite end portion adjoining said central body portion and engaging one of said respective means for resiliently urging said gripper blocks, and means for adjusting the height of said space, thereby changing the dimensions of said passage, said shaft extending through said passage, and means for moving said shaft about its longitudinal axis between first and second positions, said grippers being in a closed position for engaging a sheet of paper when said shaft is in the first position and in an open position for accepting or releasing a sheet of paper when said shaft is in the second position.

9. A printing press as described in claim 8, wherein said printing station includes a blanket cylinder adjoining said impression cylinder.

10. A printing press as described in claim 9, wherein each of said gripper blocks include a surface in opposing relation to a surface of an adjoining gripper clamp arm, and a coil spring positioned between each of said opposing surfaces and resiliently urging said gripper blocks about said shaft.

11. A printing press as described in claim 10 including an actuating arm fixedly secured to said shaft, a cam follower coupled to said actuating arm, means for resiliently urging said actuating arm to rotate in a first rotational direction, and means for limiting the rotation of said actuating arm in said first rotational direction.

12. A printing press as described in claim 8, wherein each of said grippers includes a generally flat, rigid, Z-shaped body having first and second parallel end portions, one of said end portions being secured to one of said respective gripper blocks and facing an outer wall of said impression cylinder.

13. A gripper assembly for use on an impression cylinder of a printing press, comprising:

a main shaft;

a plurality of gripper clamp arms mounted to said main shaft;

a plurality of gripper blocks rotatable mounted to said main shaft in adjoining relation, respectively, to said gripper clamp arms, a portion of each of said respective gripper blocks being in opposing relation to a portion of each of said respective gripper clamp arms;

a plurality of springs positioned, respectively, between said opposing portions of said gripper blocks and gripper clamp arms, said springs urging said gripper blocks in a first rotational direction about said main shaft;

a plurality of grippers mounted, respectively, to each of said gripper blocks, each of said grippers being positioned on the opposite side of said main shaft from said springs;

a frame assembly for rotatably supporting said main shaft, and mounting means for mounting said frame assembly to an impression cylinder.

14. A gripper assembly as described in claim 13 including a cam follower and means for coupling said cam follower to said main shaft such that said main shaft rotates about an axis when said cam follower is engaged by a cam.

15. A gripper assembly as described in claim 14, wherein each of said gripper blocks includes a projection extending substantially parallel to said main shaft, said springs respectively urging said projections away from said respective portions of said gripper clamp arms.

16. A gripper assembly as described in claim 15, wherein each of said gripper clamp arms includes a first end portion, a second end portion, and a central body portion connecting said first and second end portions, said central body portion including a passage for receiving said main shaft and a surface abutting said projection of said gripper block.

17. A gripper assembly as described in claim 13, wherein each of said grippers comprises a generally flat, Z-shaped body having first and second parallel end members and a connecting member connecting said first and second end members, said second end members being secured, respectively, to said gripper blocks.

18. A gripper assembly for use on an impression cylinder of a printing press, comprising:

a main shaft;

a plurality of gripper clamp arms mounted to said main shaft;

a plurality of gripper blocks rotatable mounted to said main shaft in adjoining relation, respectively, to said gripper clamp arms, a portion of each of said respective gripper blocks being in opposing relation to a portion of each of said respective gripper clamp arms;

a plurality of springs positioned, respectively, between said opposing portions of said gripper blocks and gripper clamp arms, said springs urging said gripper blocks in a first rotational direction about said main shaft;

a plurality of grippers mounted, respectively, to each of said gripper blocks, each of said grippers including first and second substantially parallel end portions extending in opposite directions and a connecting portion connecting said first and second end portions, said first end portion including a lower surface adapted for engaging a paper sheet upon an impression cylinder, said second end portion being removably secured to one of said gripper blocks;

a frame assembly for rotatably supporting said main shaft, and mounting means for mounting said frame assembly to an impression cylinder.

19. A gripper assembly as described in claim 18 wherein each of said gripper blocks includes an opening, each of said second end portions of said grippers includes an open-ended slot aligned with one of said openings, and a bolt extends through each of said openings and slots, thereby securing said grippers to said gripper blocks.

20. A gripper assembly as described in claim 19 wherein each of said gripper blocks includes a shoulder adjoining one of said second end portions of said respective grippers.

* * * * *